US006062844A

United States Patent [19]

Biro

[11] Patent Number: 6,062,844

[45] Date of Patent: May 16, 2000

[54] APPARATUS FOR MANUFACTURING AN ELONGATED FLOORING MEMBER

[76] Inventor: Michael Julius Biro, 4014 NW. 24th Ter., Boca Raton, Fla. 33065

[21] Appl. No.: 09/228,734

[22] Filed: Jan. 12, 1999

Related U.S. Application Data

[62] Division of application No. 09/079,665, May 14, 1998, Pat. No. 5,904,011

[60] Provisional application No. 60/070,646, Jan. 7, 1998.

[51] Int. Cl.[7] ..... B63B 35/44

[52] U.S. Cl. ..... 425/327; 425/363

[58] Field of Search ..... 425/327, 363

[56] References Cited

U.S. PATENT DOCUMENTS 4,330,254 5/1982 Cunningham ..... 425/466
5,512,234 4/1996 Takizawa et al. ..... 425/327
5,770,122 6/1998 Curchod ..... 425/327

FOREIGN PATENT DOCUMENTS 563937 6/1957 Italy ..... 425/327

*Primary Examiner*—Robert Davis
*Assistant Examiner*—Thukhanh T. Nguyen
*Attorney, Agent, or Firm*—Ronald V. Davidge

[57] ABSTRACT

An elongated flooring member includes an array of pyramid-shaped tread members to form an anti-skid surface. Longitudinally extending features of the flooring member are formed by an extrusion process which is followed by an embossing process to cut extruded flutes into the pyramid-shaped tread members. A first version of the flooring member includes a pair of channels extending downward from an upper web on which the tread is formed, for attachment to a substrate. A second version of the flooring member has an adhesive layer fastened under the upper web for attachment to a single plank.

9 Claims, 3 Drawing Sheets

APPARATUS FOR MANUFACTURING AN ELONGATED FLOORING MEMBER

CROSS-REFERENCE TO A RELATED APPLICATION

This application is a division of a U.S. patent application Ser. No. 09/079,665, filed May 14, 1998, now U.S. Pat. No. 5,904,011, which claims the benefit of U.S. Provisional Application No. 60/070646, filed Jan. 7, 1998.

BACKGROUND OF THE INVENTION

1. Field of the Invention

This invention relates to extruded plastic materials for covering wood or cement surfaces of boat docks and residential decks, and, more particularly, to providing such extruded plastic materials with surfaces preventing slip and fall accidents under wet conditions.

2. Background Information

Many boat docks and residential decks are comprised of a wooden floor, made of individual planks, nailed in place over a wooden framework. One problem with this type of construction arises from the fact that the upper surface of the floor is exposed to ambient conditions which cause relatively rapid deterioration of the wood. In particular, the ultraviolet rays of sunlight cause deterioration of the wood near its surface, and moisture from dew, rain, or in the case of a boat dock, from splashing, aids in the initiation of rotting. While chemical preservatives often lengthen the usefulness of the wood flooring, the wood continues to deteriorate into a condition requiring replacement. During this process of deterioration, the appearance of the wood surfaces becomes aesthetically undesirable, and the flooring may become dangerous due to splintering and even collapsing.

What is needed is a structure for covering the flooring of wood boat docks and residential decks to prevent deterioration of the wood. Such a structure would be especially useful if it could be used to cover wood flooring which has a ready been damaged by ambient exposure.

Conventional extruded flooring products, which may be made of plastic, rubber, or aluminum, have, on their upper surfaces, longitudinally extending ridges or grooves without any such features extending transversely. While this type of surface configuration is understandable considering the extrusion process by which such products are made, the result is a flooring surface which provides good traction for walking in the transverse direction, but which is found to be very slippery when a person tries to walk in the longitudinal direction. While this difference in frictional properties can be enough to cause a fall even under dry conditions, under wet conditions such flooring products can become especially dangerous.

Many dock and deck surfaces become very dangerous from the standpoint of slipping and falling when they covered by a substantial thickness of water, as during a rainstorm. Once a person's foot begins to slip, a condition of hydroplaning occurs between his foot (or the sole of his shoe) and the surface of the flooring. Under this condition, the surfaces of his foot and of the flooring do not contact one another, being instead separated by a water layer. The friction force acting between the foot and the flooring, which normally must be relied upon to prevent a fall, is now independent of the coefficient of friction of the solid materials involved, reaching a low value dependent instead on the fluid shear occurring within the water. Under such conditions, the friction force can rapidly drop to about 1/100 of its value under dry conditions. In particular, serious knee injuries occur when one foot slips in a wet area while the other foot remains stuck to the floor in an adjacent dry area, so that the knee of the foot which is not slipping is severely twisted.

What is needed is a surface for boat docks, residential decks, and the like, in which the contact surface is broken up into small sectors, so that the pressure between the foot and the contact surface is increased, reducing the chance of hydroplaning, and so that the relatively large surface areas, which are associated with the initiation of hydroplaning, are avoided. While the use of grooves and ridges extending only in the longitudinal direction in extruded flooring products performs this function to an extent, the difference in the sliding properties of such products between longitudinal and transverse directions argues against the use of such products in areas likely to become soaked with water.

3. Description of the Related Art

U.S. Pat. No. 5,009,045 describes a plastic plank member, for use with a deck arrangement, having a rigid base portion and a tread portion attached thereto, which are integrally extruded of suitable plastics. The rigid portion of the plank member is adapted to be secured to an underlying support structure. The tread portion is formed with protrusions projecting upwardly away from the tread and grooves formed therein. The characteristics of the thread result in a sufficiently high coefficient of friction to reduce the possibility of slipping on the plank member.

However, under the particularly dangerous conditions of heavy rain or splashed water, after hydroplaning is begun as part of a scenario of slipping and falling down, the coefficient of friction of the tread portion does not matter, with the frictional drag on a slipping foot being instead determined by fluid shear occurring within the water. In fact, the tread surface described in this patent includes a number of relatively large, diamond-shaped flat surfaces, surrounded by shallow ridges and grooves. In spite of the provisions made for drainage through grooves and channels, water is not rapidly drained from such surfaces, so that a fairly thick layer of water is expected to remain on these surfaces during a heavy rain.

U.S. Pat. No. 5,048,448 and U.S. Pat. No. Des. 329,914 each describe flooring material having grooves or ridges extending only longitudinally. As described in the above section, it is particularly easy to fall on such flooring because of the unexpected great difference in its frictional properties between longitudinal and transverse directions.

Therefore, what is needed is an elongated plank member having a contact surface which is broken up into small sectors, with breaks among sectors extending in both longitudinal and transverse directions, so that the pressure between the foot and the contact surface is increased, reducing the chance of hydroplaning.

SUMMARY OF THE INVENTION

Accordingly, it is a first objective of the present invention to provide a flooring surface which can readily be attached to planking in a manner protecting the planking from environmental damage.

It is another objective of the present invention to provide a flooring surface which can readily be attached to cover an environmentally damaged wood or concrete surface.

It is another objective of the present invention to provide a flooring surface which can be fastened in place over a pre-existing flooring surface by means of screws extending within channels covered with snap-in cover strips.

It is another objective of the present invention to provide an upper flooring surface, fastened over a lower flooring surface, in which squeaking due to relative movement between these flooring surfaces is minimized.

It is another objective of the present invention to provide a plastic flooring surface including snap-in cover strips, in which squeaking due to relative motion between the strips and adjacent structural members is minimized.

According to a first aspect of the present invention, there is provided apparatus for forming an elongated flooring member having an anti-skid tread pattern. The apparatus includes an extrusion die, a back-up roller, and an embossing roller. Thermoplastic material is extruded through the extrusion die, with includes a number of notches forming flutes extending along a first side of the material forming the elongated flooring member. The back-up roller rolls along a side of the material forming the elongated flooring member opposite the first side of this material. The embossing roller has a cylindrical periphery with a number of roller flutes extending longitudinally, engaging the flutes extending along the first side of the material to cut notches therein. The extrusion die may include tabs with convex curvature between the notches within the number of notches forming flutes.

DETAILED DESCRIPTION

Figure 1:
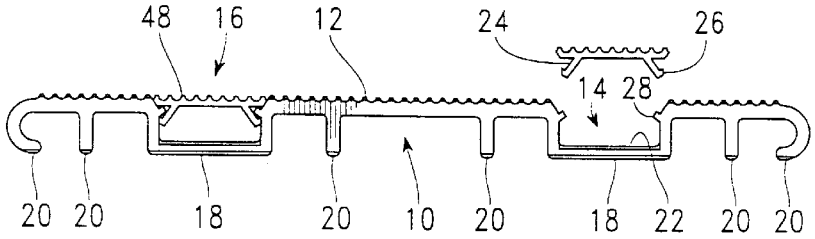
FIG. 1 is an end view of an elongated member built in accordance with a first embodiment of the present invention to form part of a floor covering, together with a pair of cover strips, one of which is in an exploded relationship with the elongated member, covering screw mounting channels within the elongated member.

FIG. 1 is an end view of an elongated member 10 built in accordance with a first embodiment of the present invention. The elongated member 10 includes an anti-skid tread 12 on its upper surface, and a pair of channels 14 forming positions for screw attachment to a subsurface (not shown) extending under the elongated member 10. A pair of cover strips 16, one of which is shown in an exploded relationship with the elongated member 10, are snapped into place to cover the troughs 14, hiding the screws used for attachment to the subsurface. The elongated member 10 is preferably composed of a structural PVC, being formed by an extrusion process. A soft PVC is preferably coextruded with the more rigid structural PVC to form softened contact surfaces 18 along the lower surfaces of the troughs 14, additional softened contact surfaces 20 in other places where contact between the elongated member 10 and the subsurface can occur, and softened upper surfaces 22 of the troughs, which are clamped under the heads of screw fasteners (not shown) fastening the elongated member 10 to a subsurface. The soft PVC is characterized by having a modulus of elasticity which is substantially lower than the modulus of elasticity of the rigid structural PVC. Each cover strip 16 includes, extending along each side, an integral flexible latching strip 24 having a hook 26 which is trapped under a corresponding tab 28 extending along the elongated member 10 on each side of the trough 14, when the cover strip 16 is pressed into place within the trough 14.

Figure 2:
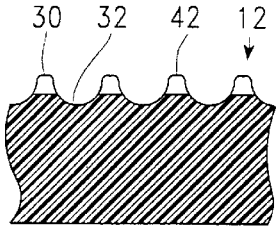
FIG. 2 is an enlarged fragmentary transverse cross-sectional view of the elongated member of FIG. 1, showing details of an anti-skid pattern forming a tread surface thereof.

FIG. 2 is an enlarged fragmentary transverse cross-sectional view of the elongated member 10 of FIG. 1, showing details of an anti-skid tread surface 12 thereof. The anti-skid surface 12 extending along the upper surface of the elongated member 10 includes a number of flutes 30, separated by rounded channels 32, which are particularly useful in storing and carrying away water. These flutes 30 and channels 32 are preferably made as integral parts of the elongated member 10 during the extrusion process.

Figure 2A:
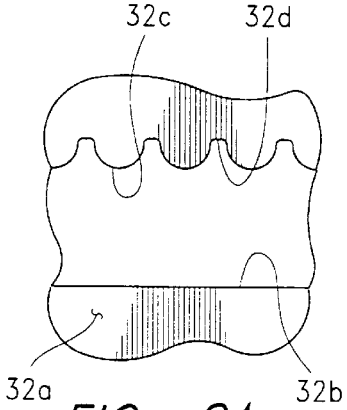
FIG. 2A is an enlarged fragmentary front elevation of an extrusion die used to form the anti-skid pattern of FIG. 2.

FIG. 2A is an enlarged fragmentary front view of in extrusion die 32*a* used in the production of the anti-skid tread surface of FIG. 2. This die 32*a* includes an aperture 32*b* through which the thermoplastic material forming the elongated member 10 is pushed. This aperture 32*b* includes downward-extending sections 32*c* forming the rounded channels 32 and slots 32*d* forming the flutes 30.

Figure 4:
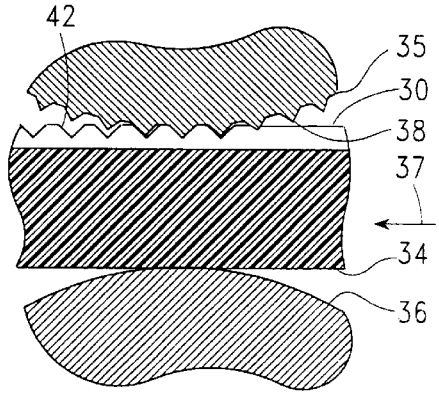
FIG. 4 is a fragmentary transverse cross-sectional view of the embossing station of FIG. 3.
Figure 3:
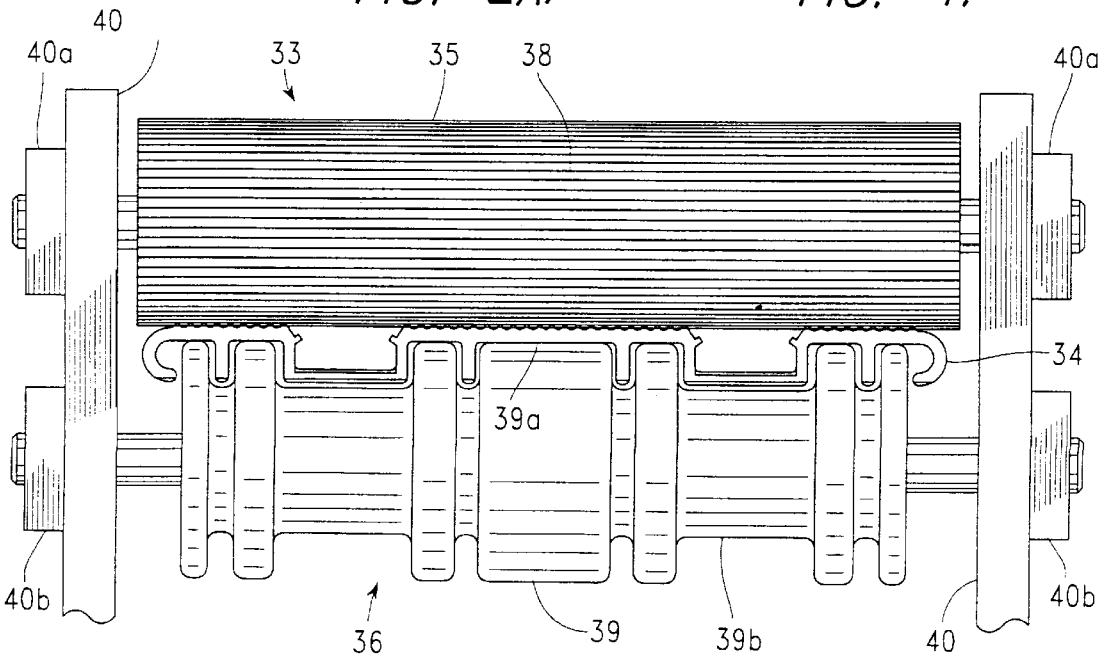
FIG. 3 is a front elevation of an embossing station used to apply a series of transversely extending grooves to finish forming the anti-skid pattern of FIG. 2.

FIGS. 3 and 4 are views of an embossing station 33 used to apply a series of transversely extending grooves to finish forming the anti-skid surface 12 along the upper surface of the elongated member 10, with FIG. 3 being a front elevational view of the embossing station 33, while FIG. 4 is a fragmentary transverse cross-sectional view thereof.

Referring to FIGS. 3 and 4, the embossing station 33 is placed beyond an extruding section (not shown) including the die 32 of FIG. 2A, which forms the various longitudinally extending features of the elongated member 10, in a position where the extruded material 34 proceeding through the embossing station retains enough heat for the extrusion process to be easily formed. The extruded material 34 is run between an embossing roll 35 and a back-up roll 36, in the direction of arrow 37. The embossing roll 35 includes a number of flutes 38 extending lengthwise along its surface. The back-up roll 36 includes a number of contact sections 39 rolling against the lower surface of the upper web portions 39*a* of the extruded material 34 and a number of reduced-diameter sections 39*b* providing clearance for portions of the extruded material 34 which descend from the upper web portions 39*a* thereof. The embossing roll 35 is rotatably mounted within a framework to by means of a pair of bearing blocks 40*a*. The back-up roll 36 is rotatably mounted within the framework 40 by means of a pair of bearing blocks 40*b*. The distance between these rolls 35, 36 is set using adjusting screws (not shown), or a constant force is applied to one of the rolls 35, 36 by means of a spring mechanism (not shown), or a constant force is applied to one of the rolls 35, 36 by means of a spring mechanism (also not shown).

This process forms the upper portion of each flute 30 into a number of small upward-extending truncated pyramids 42, providing an anti-skid surface 12 which resists slipping on the elongated member 10 in both its transverse and longitudinal directions. This type of anti-skid surface, and the manufacturing process by which it is made, can be used in other applications, as well, within the scope of the present invention.

This type of anti-skid surface 12 has a particular ad vantage over conventional tread patterns, and over the tread patterns described in U.S. Pat. No. 5,048,448 and U.S. Pat. No. Des. 329,914 in that the grooves in the anti-skid surface 12 extend in both transverse and longitudinal directions, preventing slipping in both these directions. Since the frictional properties of the anti-skid surface 12 are similar in transverse and longitudinal directions, a surprising change in frictional properties, which can result in a slip and fall accident, is avoided.

This type of anti-skid surface 12 also has a particular advantage over the tread pattern described in U.S. Pat. No. 5,009,045, in that the anti-skid surface 12 includes a number of very small contact surfaces formed at the tops of truncated pyramids 42. These contact surfaces are small enough that the contact pressure between a person's foot and the surface 12 is greatly increased over that experienced with the relatively large, diamond-shaped contact surfaces described in this patent from the background art. This significant increase in contact pressure reduces the chances that hydroplaning can occur, with water being squeezed out of the contact spaces between the person's foot, or the sole of his shoe, and the tops of the truncated pyramids 42. This effect reduces the danger of slipping even if the anti-skid surface 12 is completely under water. Furthermore, under rain conditions, it is much easier to squeeze water into the grooves extending around each pyramid 42 than into the smaller grooves extending around each of the much larger diamond-shaped contact surfaces of the background art patent.

Referring again to FIG. 1, while the process of FIGS. 3 and 4 may also be applied to the flutes 43 of the cover strips 16, such additional processing is generally not required, since these strips 16 are narrow enough that the shape of adjacent flutes in the surface 12 prevent slipping.

Figure 5:
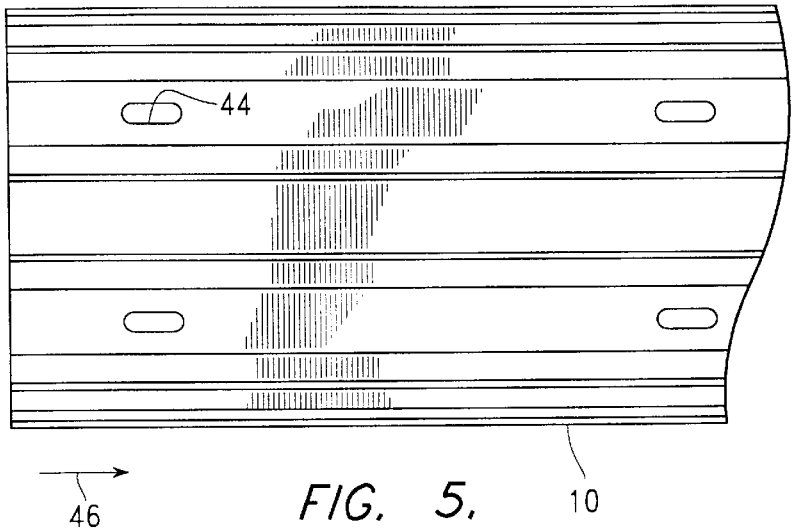
FIG. 5 is a fragmentary bottom plan view of the elongated member of FIG. 1.

FIG. 5 is a fragmentary bottom plan view of the elongated member 10 of FIG. 1, which includes a number of elongated holes 44, provided for screw attachment to a subsurface (not shown). These holes 44 are placed every 20–26 cm (8–10 inches) in the longitudinal direction indicated by arrow 46. These holes 44 are elongated to provide additional tolerance in the placement of fasteners and to provide for elongation resulting from ambient conditions, such as temperature and humidity. Each hole 44 is centrally located within a trough 14 (shown in FIG. 1).

Figure 6:
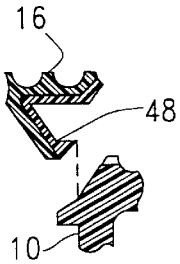
FIG. 6 is an enlarged fragmentary transverse cross-sectional view of latching surfaces used to hold the cover strips of FIG. 1 in place on the elongated member of FIG. 1.
Figure 7:
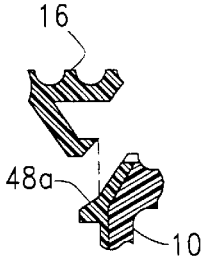
FIG. 7 is an enlarged fragmentary transverse cross-sectional view of a first alternate form of latching surfaces used to hold the strips of FIG. 1 in place on the elongated member of FIG. 1.
Figure 8:
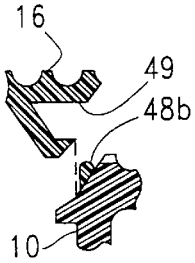
FIG. 8 is an enlarged fragmentary transverse cross-sectional view of a second alternate form of latching surfaces used to hold the strips of FIG. 1 in place on the elongated member of FIG. 1.
Figure 9:
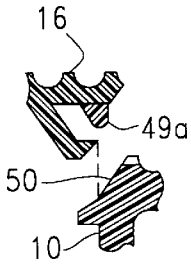
FIG. 9 is an enlarged fragmentary transverse cross-sectional view of a first alternate form of latching surfaces used to hold the strips of FIG. 1 in place on the elongated member of FIG. 1.

FIGS. 6–9 show alternative ways in which a soft PVC layer is applied to a mating surface of the elongated member 10 or of the cover strips 16. This is done so that the cover strips 16 will be held tightly on the elongated member 10, with the soft PVC layer in compression, to eliminate squeaking due to relative motion between the strips 16 and the elongated member 10. Such relative motion would otherwise occur with walking on the flooring material. Each such FIG. 6–9 is an enlarged fragmentary transverse cross-sectional view showing a strip of soft PVC which is coextruded with the relatively rigid PVC forming a structural portion of the part. Again, the soft PVC is characterized by having a modulus of elasticity which is substantially lower than the modulus of elasticity of the rigid structural PVC. In the example of FIG. 6, the softer material 48 forms the latching surface of the cover strip 16. In the example of FIG. 7, the softer material 48*a* forms the latching surface of the elongated member 10. In the example of FIG. 7, the softer material 48*a* forms the latching surface of the elongated member 10. In the example of FIG. 8, the softer material 48*b* extends upward from the elongated member 10 to be compressed by engaging an undersurface 49 of the cover strip 16. In the example of FIG. 9, the softer material 49 extends downward from the cover strip 16 to engage an inclined surface 50 of the elongated member 10.

Figure 10:
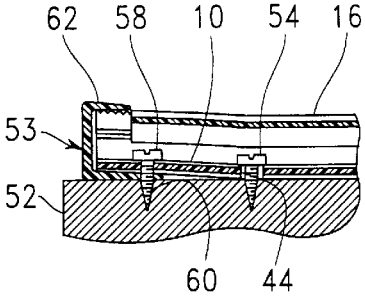
FIG. 10 is a fragmentary longitudinal cross-sectional view of the elongated member and a strip of FIG. 1, fastened to a subsurface by means of screws, together with an end cap strip.

FIG. 10 is a fragmentary longitudinal cross-sectional view of the elongated member 10 and a strip 16 of FIG. 1, fastened to a subsurface 52, together with an end cap strip 53. To cover the subsurface 52, a number of elongated members 10 are fastened in place, lying parallel to one another as planks on the subsurface 52, by means of a screws 54 extending through elongated holes 44. The subsurface 52 may be, for example, wooden planking or a concrete surface. An end cap strip 55 is also fastened in place to cover the ends of the elongated members 10, by means of a number of screws 58 extending into the subsurface 52 through holes drilled in various of the members 10 and in the lower flange 60 of the end cap strip 56. This lower flange 60 is longer than an upper flange 62 of the cap strip 53, so that access to the screw 58 is provided from above. Both of the flanges 60 and 62 are tapered.

Figure 11:
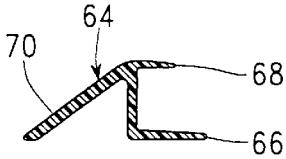
FIG. 11 is a transverse cross-sectional view of a first alternative end cap strip, which is used in place of the end cap of FIG. 10.

FIG. 11 is a transverse cross-sectional view of a first alternative end cap strip 64, which also includes a lower flange 66 which is longer than its upper flange 68, so that screw attachment in the manner of FIG. 10 may be achieved. An inclined flange 70 acts as a small ramp when the elongated members 10 are applied to only a portion of a flat surface. For example, these members 10 may be used to cover a wooden dock extending in a flush alignment from a concrete walkway.

Figure 12:
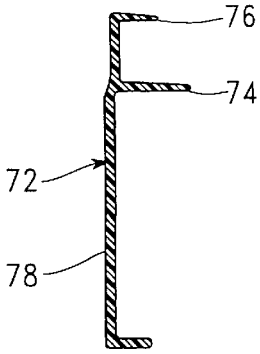
FIG. 12 is a transverse cross-sectional view of a second alternative end cap strip, which is also used in place of the end cap of FIG. 10.

FIG. 12 is a transverse cross-sectional view of a second alternative end cap strip 72, which also includes a lower flange 74 which is longer than its upper flange 76, so that screw attachment in the manner of FIG. 10 may be achieved. A downward-extending sidewall 78 is provided to cover the end of a subsurface, such as the ends of a number of planks forming the subsurface.

Each end cap strip 53, 64, 72 is preferably of a sufficient length to cover the ends of a number of elongated flooring members 10 m when the members 10 are installed along a deck or dock in a parallel relationship.

Figure 13:
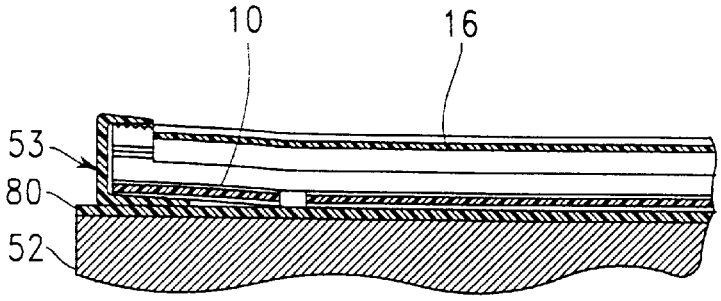
FIG. 13 is a fragmentary longitudinal cross-sectional view of the elongated member and a strip of FIG. 1, fastened to a subsurface by means of an adhesive layer, together with an end cap strip.

FIG. 13 is a fragmentary longitudinal cross-sectional view of the elongated member 10, together with the strip 16 and the end cap 53, fastened to the substrate 52 by means of an adhesive layer 80, which is, for example, composed of styrene butedine styrene reinforced by acentrally extending polyester membrane, having an overall thickness of 0.75–2 mm (0.03–0.8 inch). Several adhesive strips of this kind may be applied in a spaced apart relationship, extending perpendicularly to the longitudinal direction of a number of elongated members 10 placed on a deck or dock. This type of assembly is preferable when the substrate 52 is composed of concrete, since it is so difficult to set screws in this material.

Figure 14:
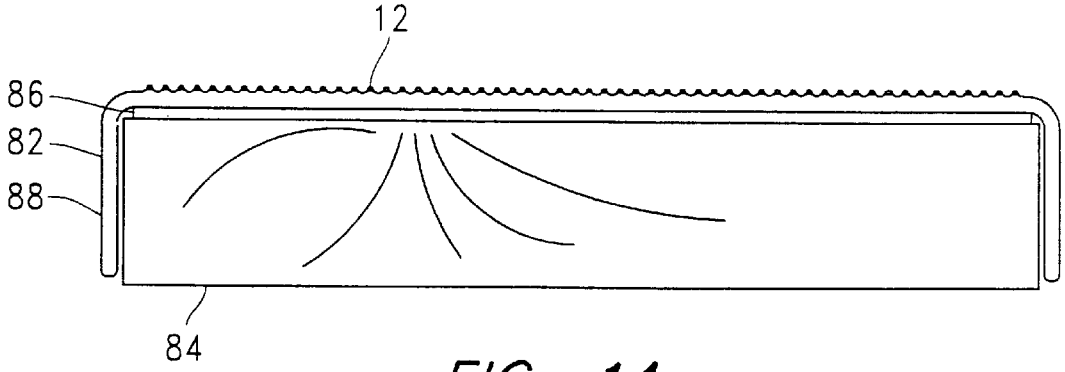
FIG. 14 is an end view of an elongated member built in accordance with a second version of the present invention, including an anti-skid pattern of the elongated member of FIGS. 1 and 2.

FIG. 14 is an end view of an elongated member 82, built in accordance with a second version of the present invention, including the anti-skid tread pattern 12 previously described in reference to FIGS. 1 and 2. This elongated member 82 is also extruded, with the tread pattern 12 being formed by the general process described above in reference to FIGS. 1 and 2. This elongated member 82 is also extruded, with the tread pattern 12 being formed by the general process described above in reference to FIGS. 2A, 3, and 4. As shown in FIG. 14, this elongated member 82 is fastened to a plank 84, forming part of a dock or residential deck, by means of an adhesive layer 86, which preferably has the composition described above, in reference to FIG. 13, of the adhesive layer 80. The elongated member 82 includes a flat upper web 87, to which the adhesive layer 86 is fastened, and a pair of side webs 88, extending downward outside the width of an ordinary plank 84.

Figure 15:
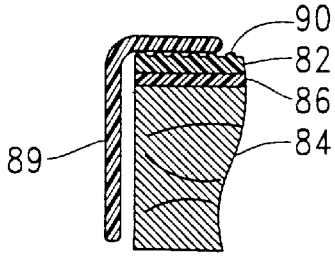
FIG. 15 is a fragmentary longitudinal view of the elongated member of FIG. 14 together with a first type of end cap.
Figure 16:
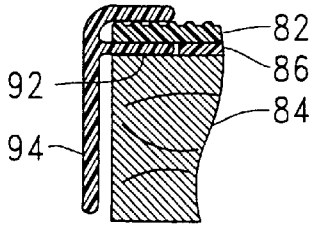
FIG. 16 is a fragmentary longitudinal view of the elongated member of FIG. 14 together with a second type of end cap.

While FIG. 14 shows this arrangement without an (end cap, FIGS. 15 and 16 show alternative types of end caps which may be used with the elongated member 82. Each FIG. 15 and 16 is a fragmentary longitudinal cross-sectional view of the elongated member 82, together with an end cap. Referring to FIG. 15, a first type of end cap 89 extends along a number of elongated members 82, being adhesively attached to the top surfaces 90 of these members 82. Referring to FIG. 16, the adhesive layer 86 is trimmed to allow the insertion of an intermediate tab 92 of a second type of end cap 94. This end cap 94 is adhesively attached to the elongated member 82. End cap 82 has a length sufficient to cover the end of only one plank 84, or it may extend to cover a number of such planks. If the end cap is to cover a number of planks 84, the intermediate tab 92 must be divided to extend as separate tabs into the space adjacent each such plank.

While the invention has been described in its preferred forms or embodiments with some degree of particularity, it is understood that this description has been given only by way of example and that numerous changes in the details of construction, fabrication, and use, including the combination and rearrangement of parts, may be made without departing from the spirit and scope of the invention.

What is claimed is:

1. Apparatus for forming an elongated flooring member having an anti-skid pattern, wherein said apparatus comprises:

an extrusion die through which a thermoplastic material is extruded in a longitudinal direction, wherein said extrusion die includes a plurality of notches forming flutes extending in said longitudinal direction along a first side of an upper web within said elongated flooring member, wherein a second side of said upper web, opposite said first side of said upper web, includes a flat surface extending opposite said first side of said upper web;

an embossing roller, mounted to rotate, about a first axis of rotation, against said first side of an upper web, wherein said embossing roller has a cylindrical periphery with a plurality of roller flutes extending parallel to said first axis of rotation, engaging said flutes extending along said upper side of said upper web to cut notches therein; and a back-up roller mounted to rotate about a second axis of rotation, parallel to said first axis of rotation, wherein said back-up roller extends in a spaced-apart relationship with said first roller, wherein said thermoplastic material is extruded to pass between said embossing roller and said back-up roller, and wherein said back-up roller includes a cylindrical contact surface rolling against said flat surface.

2. The apparatus of claim 1, wherein said extrusion die includes tabs with convex curvature between notches within said plurality of notches forming flutes.

3. The apparatus of claim 1, wherein said roller flutes divide said flutes extending along said upper side of said upper web into a number of tread structures shaped as truncated pyramids.

4. The apparatus of claim 1, wherein said elongated flooring member includes a side wed extending downward along each side of said flat surface; and said back-up roller includes reduced-diameter sections providing clearance for each said side web.

5. Apparatus for forming an elongated flooring member having an anti-skid pattern, wherein said apparatus comprises:

an extrusion die through which a thermoplastic material is extruded, wherein said extrusion die includes a plurality of notches forming flutes extending along a first side of an upper web within said elongated flooring member, wherein a second side of said upper web, opposite said first side of said upper web, includes a plurality of flat surfaces extending opposite said first side of said upper web;

an embossing roller, mounted to rotate, about a first axis of rotation, against said first side of an upper web, wherein said embossing roller has a cylindrical periphery with a plurality of roller flutes extending parallel to said first axis of rotation, engaging said flutes extending along said upper side of said upper web to cut notches therein; and a back-up roller mounted to rotate about a second axis of rotation, parallel to said first axis of rotation, wherein said back-up roller extends in a spaced-apart relationship with said first roller, wherein said thermoplastic material is extruded to pass between said embossing roller and said back-up roller, wherein said elongated flooring member includes a plurality of structures extending downward from said upper web between flat surfaces in said plurality of flat surfaces, and wherein said back-up roller includes a plurality of cylindrical surfaces against which said plurality of flat surfaces roll and a plurality of reduced diameter sections through which said plurality of structures pass.

6. The apparatus of claim 5, wherein said roller flutes divide said flutes extending along said upper side of said upper web into a number of tread structures shaped as truncated pyramids.

7. The apparatus of claim 5, wherein said plurality of structures includes a channel extending longitudinally and downward from said upper web, and said channel includes a flat lower web having a lower surface defining a lowermost surface of said elongated flooring member.

8. The apparatus of claim 7, wherein said plurality of structures includes a flange web extending longitudinally and downward from said upper web, and said flange web includes a tip surface extending in alignment with said flat lower web.

9. The apparatus of claim 5, wherein said plurality of structures includes a flange web extending longitudinally and downward from said upper web, and said flange web includes a tip surface defining a lowermost surface of said elongated flooring member.

* * * * *